United States Patent [19]

Schuster

[11] Patent Number: 4,677,705

[45] Date of Patent: Jul. 7, 1987

[54] EXHAUSTER NOZZLE

[75] Inventor: Wilhelm Schuster, Frankfurt am Main, Fed. Rep. of Germany

[73] Assignee: Allstar Verbrauchsguter GmbH, Frankfurt am Main, Fed. Rep. of Germany

[21] Appl. No.: 839,972

[22] Filed: Mar. 17, 1986

[51] Int. Cl.[4] ..... A47L 9/06

[52] U.S. Cl. ..... 15/398; 15/420

[58] Field of Search ..... 15/420, 398

[56] References Cited

U.S. PATENT DOCUMENTS

| | | | |
|---|---|---|---|
| 1,992,238 | 2/1935 | Rose | 15/420 |
| 2,027,543 | 1/1936 | Lofgren | 15/420 |
| 2,164,392 | 7/1939 | Ellis | 15/420 X |
| 2,885,716 | 5/1959 | Brown | 15/420 X |
| 2,934,780 | 5/1960 | Taplin | 15/420 X |

FOREIGN PATENT DOCUMENTS

| | | | |
|---|---|---|---|
| 862654 | 1/1953 | German Democratic Rep. | 15/420 |
| 1030979 | 5/1958 | German Democratic Rep. | 15/420 |
| 309158 | 11/1955 | Switzerland | 15/420 |

*Primary Examiner*—Chris K. Moore

*Attorney, Agent, or Firm*—Franklin D. Wolffe; Morris Fidelman

[57] ABSTRACT

An exhauster nozzle for cleaning surfaces is described, which consists of a nozzle element which encloses a suction chamber and is provided with a connecting suction pipe. The open side of the nozzle element is closed by an adapter plate made of metal or plastic and exhibiting a suction orifice. A plurality of axially juxtaposed and mutually merging substantially circular or oval chambers are provided on the outside of the adapter plate, into which chambers obliquely oriented air supply ducts starting from the edges of the adapter plate lead tangentially. At least some of the chambers are open relative to the suction chamber of the nozzle element and form the suction orifice in the adapter plate. The remaining chambers are preferably closed relative to the suction chamber by a bottom plate.

7 Claims, 3 Drawing Figures

EXHAUSTER NOZZLE

The invention relates to an exhauster nozzle consisting of a nozzle element enclosing a suction chamber the open side of which is closed by a fixed or exchangeable adapter plate exhibiting a suction orifice, the nozzle element having means for connection to a suction pipe.

Exhauster nozzles for cleaning surfaces are known and widespread in a wide variety of constructions as vacuum cleaner nozzles with and without attachable adaptor plates fitted to the nozzle element. In this context, nozzles fitted with brush bristles, bristle fabric or felt are used for cleaning carpets and smooth surfaces. However, the suction effect of the vacuum cleaner itself is also a major factor in good working efficiency and such adapter plates fitted to the nozzle element serve to impair the suction effect. The nozzles also stick and tend to suck themselves firmly against the surface to be cleaned, in which case the pneumatic effect resulting from the suction is augmented by a mechanical effect. The disadvantage of the known vacuum cleaner nozzles therefore lies on the one hand in a comparatively high power consumption necessitated by the obstructed suction effect, and on the other hand in the force which must be exerted in order to operate the vacuum cleaner. Further different nozzle constructions have been required for the cleaning of different surfaces. For example, specially shaped nozzles with individual cylindrical suction tubes have been developed for high-pile carpets. Apart from the fact that such nozzles are suitable only for high-pile carpets, they also exhibit the deficiencies mentioned. Other known adapter plates, made of metal, for vacuum cleaner nozzles with a brush fitting exhibit elevations oriented in the longitudinal direction on their outside, which create air ducts for transverse currents. However, such configurations do not provide optional suction, because the numerous transverse currents which are produced partly obstruct each other and thereby impair satisfactory suction.

The aim of the present invention is to provide an exhauster nozzle of the type initially stated, which can be used without particular attachments for all surfaces to be cleaned, and which provides an improved cleaning effect over that realized with the known vacuum cleaner nozzles, with less power consumption and less exertion of force.

This aim is achieved by providing an exhauster nozzle having a plurality of axially juxtaposed and mutually merging substantially circular or oval chambers on the outside of the adapter plate, at least some of which chambers are open towards the suction chamber and lead thereinto as a suction orifice; at least one obliquely oriented air supply duct starting from the longitudinal edges of the adapter plate and closed relative to the suction chamber leading tangentially into each chamber, while the air supply ducts starting from one longitudinal edge of the adapter plate and forming a first row, and the air supply ducts starting from the other longitudinal edge and forming a second row, lead, in each case offset, into the chambers, and the air supply ducts on one side of a transverse line of the adapter plate intersecting the suction orifice are arranged in mirror-image relationship to the air supply ducts on the other side of the transverse line.

Convenient further developments of the exhauster nozzle according to the invention are characterised in the subordinate claims.

Such an exhauster nozzle is particularly suitable for vacuum cleaners. In a vacuum cleaner nozzle fitted in this manner, the total suction force of the exhauster, and therefore the energy expended, is utilized optimally. Due to the air supply ducts leading tangentially into the chambers, rotary currents and a transverse current are created with this transverse current flows past the surface to be cleaned in one direction. By this means the dirt particles enter the suction chamber virtually aligned and are exhausted. The transverse currents of the adapter plate, shaped according to the invention, of the vacuum cleaner nozzle are subdivided into eddy currents, the sum of which produces a single transverse current which consists of mutually aligned eddy currents. In each individual chamber, and therefore also on the surface to be cleaned in contact with this chamber, the air admitted rotates at high velocity, whereby a cyclone-like effect is produced which loosens and removes the particles of dirt and fiber. At the full suction capacity of a domestic vacuum cleaner, velocities of rotation of the air eddies up to 15,000 rpm were measured in the individual chambers. Due to the eddy currents, for example, the pile of a carpet to be vacuumed is set in lateral oscillation and loosened, any dust present conveyed upwards into the chamber and discharged by the transverse current. This is also the case when vacuum cleaning high-pile carpets. The exterior surface of the adapter plate is smooth and slides easily over each surface to be cleaned, irrespectively of how rough the latter is. The surface of the support of the adapter plate is comparatively large and the air supply ducts always remain open. The adapter plate is not pulled by suction into the pile of a carpet, and thus there is no partial closure of the air supply ducts and/or suction ducts, to which the high pushing force necessary with conventional vacuum cleaners is ultimately attributable. The adapter plate, made of metal or plastic with a smooth external surface and with a high work capacity, may also be used for exhausting water and, for example, for cleaning swimming pools. Apart from the excellent working efficiency which is achieved by the adapter plate according to the invention, it also presents technical advantages in production, since it can be manufactured in one piece from a pattern.

The invention is explained more fully with reference to an exemplary embodiment illustrated in the drawings, as provided for a vacuum cleaner nozzle. In the drawings.

Figure 1:
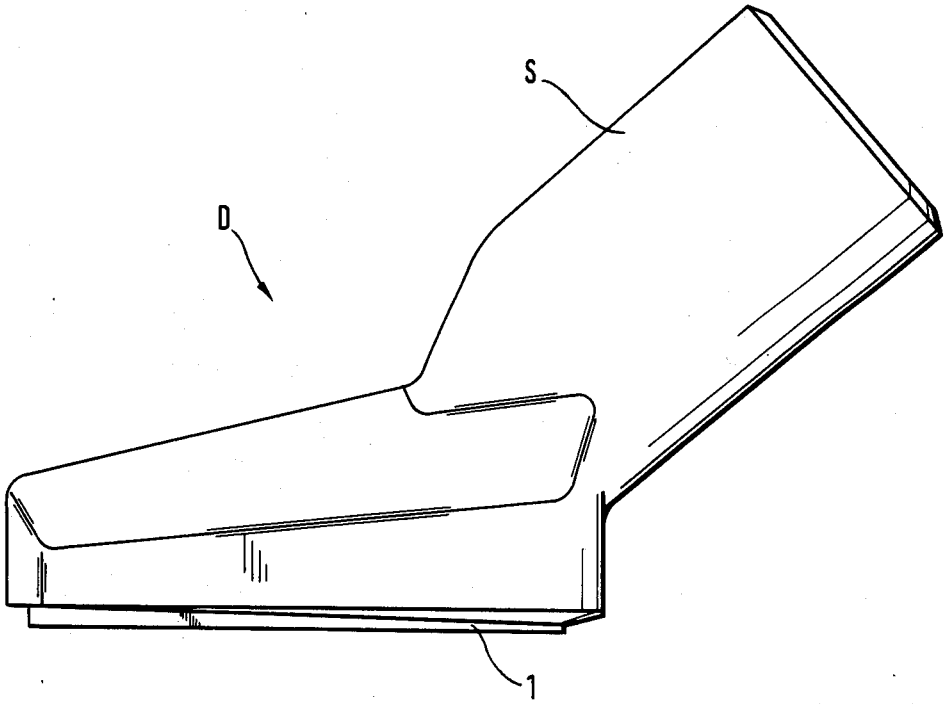
FIG. 1 shows a small-scale diagrammatic side elevation of a conventional vacuum cleaner nozzle.
Figure 2:
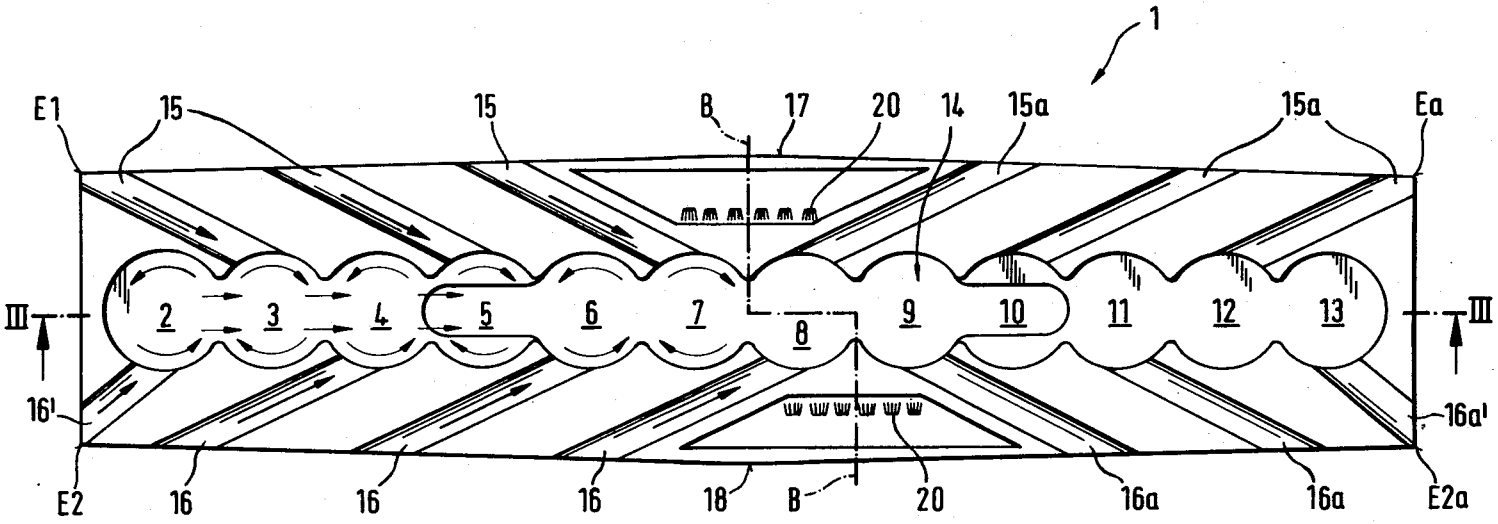
FIG. 2 shows a bottom plan of the adapter plate of the present invention.
Figure 3:
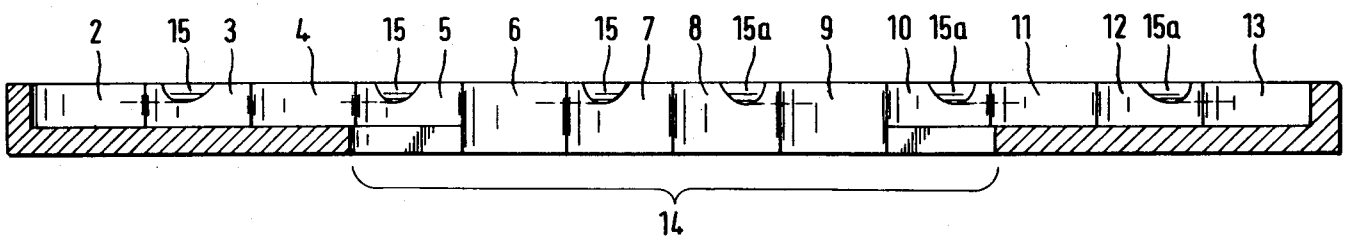
FIG. 3 shows a view in longitudinal section III—III of an adapter plate according to FIG. 2.

The vacuum cleaner nozzle (FIG. 1) consists conventionally of a nozzle element D having a connecting suction pipe S. An adapter plate 1 made of metal or plastic is arranged on the open side of the nozzle element D. In the embodiment illustrated by FIG. 2, twelve circular chambers 2 to 13 are recessed in the plane outside of the adapter plate 1, the central chambers 6, 7, 8 and 9 of which, located opposite the suction pipe S, are open towards the suction chamber of the nozzle element D. The outer chambers 2, 3, 4 and 11, 12, 13 are closed relative to the suction chamber by a bottom plate. The chambers 6, 7, 8 and 9 open towards the suction chamber form the suction orifice 14, which extends in length from chamber 5 to chamber 10, the suction orifice being however constricted in these chambers. These chambers 5 and 10 are therefore open relative to the suction chamber only in their central region, whereas the remaining chambers 6 to 9 forming the suction orifice are totally open.

An air supply duct 15, 15*a* or 16, 16', 16*a*, 16*a'* leads tangentially into each chamber 2 to 13. The air supply ducts 15, 15*a* and 16, 16', 16*a*, 16*a'* each start from a longitudinal edge 17 or 18 of the adapter plate 1 and are oriented obliquely until they lead tangentially into the chambers 2 to 13 associated with them. A row of such air supply ducts is accordingly provided on each side of the chambers 2 to 13. The air supply ducts 15 of one (the first) row and the air supply ducts 16, 16' of the other (second) row on one side of a tranverse line, B—B intersecting the suction orifice 14 are arranged substantially in mirror-image relationship to the air supply ducts 15*a*, or 16*a*, 16*a'*, on the other side of this transverse line B—B.

In the embodiment of the adapter plate 1 illustrated, the air supply ducts are arranged as follows. In the first row, three air supply ducts 15 are provided on one side of the transverse line B—B, of which one air supply duct starts from the corner E1 and the other two air supply ducts 15 from the longitudinal edge 17 of the adapter plate 1. In mirror-image relationship to these air supply ducts 15, three air supply ducts 15*a* are likewise arranged on the other side of the transverse line B—B, of which one air supply duct likewise starts from the corner Ea of the adapter plate 1. The air supply ducts 15 lead into the chambers 3, 5 and 7, that is to say, into every other chamber. Correspondingly, the air supply ducts 15*a* lead into the chambers 8, 10 and 12. As a result of this arrangement, in the first row the air supply ducts 15, 15*a* in the center of the adapter plate 1 lead into juxtaposed chambers 7 and 8.

In the secod row the air supply 16, 16*a* are arranged somewhat differently. On one side of the transverse line B—B, four air supply ducts 16' and 16 are provided, opposite which three air supply ducts 16*a* and 16*a'* are located on the other side of the tranverse line B—B. The air supply duct 16' leading into the chamber 2 starts from the corner E2 of the adapter plate 1 and corresponds to the air supply duct 16*a'* at the opposite corner E2*a* of the adapter plate 1, which leads into the outermost chamber 13. The two air supply ducts 16*a* leading into the chambers 9 and 11 are a mirror image of the air supply ducts 16 which lead into the chambers 6 and 8. Again in this second row, therefore, an arrangement is obtained in which the air supply ducts 16' and 16 on one side of the transverse line B—B lead into every other chamber, 2, 4, 6 and 8, and the air supply ducts 16*a* and 16*a'* on the other side of the transverse line B—B into every other chamber 9, 11 and 13, while chambers 8 and 9 located juxtaposed on the transverse line B—B are now also affected by air supply ducts 16 and 16*a* respectively. As a result of this arrangement, an air supply duct 15*a* of one row and an air supply duct 16 of the other row lead into the chamber 8.

This arrangement illustrated is convenient, but not compulsory.

In a preferred embodiment of the adapter plate 1, space is made on both sides of the suction orifice 14 for the attachment of a brush fitting. In a particularly advantageous embodiment, such a brush fitting consists of strips 20 of oblique-bristle fabric.

The depth of the chambers 2 to 13 relative to the depth of the air supply ducts 15, 15*a*, 16, 16' and 16*a'* is conveniently mutually coordinated, the chambers being approximately twice as deep as the air supply ducts.

The adapter plate may be connected permanently to a nozzle element, but it may also, like other adapter plates or auxiliary brushes, be of detechable, and therefore exchangeable, construction. There are numerous devices for this purpose which permit an engagement of the plate on the nozzle element.

I claim:

1. An exhauster nozzle for use in cleaning surfaces, said nozzle comprising:

an element enclosing a suction chamber and provided with a connecting suction pipe;

said element closed on the open side by an adapter plate;

said adaptor plate provided with a plurality of abutting and mutually merging substantially circular chambers, said chambers opening on the outside of said adaptor plate and at least one chamber being open to said suction chamber, said chambers situated essentially along the longitudinal axis of said adaptor plate;

air supply ducts situated on both longitudinal edges of said adaptor plate;

at least one air supply duct obliquely oriented in the direction of said suction chamber leading tangentially into each chamber from said longitudinal edges of said adaptor plate; and said air supply ducts arranged on said longitudinal edges opening alternately into succeeding chambers.

2. An exhauster nozzle as defined by claim 1 wherein a strip of oblique-bristle fabric is arranged on end of the longitudinal sides of the suction orifice.

3. An exhauster nozzle as defined by claim 1 wherein said suction orifice is situated at substantially the center of the longitudinal axis of said adaptor plate, and the air ducts situated on one side of a transverse line intersecting said suction orifice are arranged in mirror-image relationship with the air supply ducts situated on the opposing side of said transverse line.

4. An exhauster nozzle as defined by claims 1 or 3 wherein said air supply ducts leading tangentially into the outermost chambers of said adaptor plate start from the corners between transverse edges and longitudinal of said adaptor plate.

5. An exhauster nozzle as defined by claim 1 wherein the central chambers of said adaptor plate located opposite said suction pipe of the nozzle element are open towards said suction chamber and lead thereinto as an elongate suction orifice and the remaining chambers are closed towards said suction chamber by a bottom plate.

6. An exhauster nozzle as defined by claim 5 wherein said elongate suction orifice is extended into each of the two chambers adjacent the ends of said orifice and constricted in said chambers.

7. An exhauster nozzle as defined by claims 3, 4, 5 or 6 wherein the chambers which are totally or partially closed relative to the suction chamber are deeper than the air supply ducts.

* * * * *